US011139547B2

(12) United States Patent
Miyamoto et al.

(10) Patent No.: US 11,139,547 B2
(45) Date of Patent: Oct. 5, 2021

(54) TUNABLE BANDPASS FILTER AND METHOD OF FORMING THE SAME

(71) Applicant: NEC Corporation, Tokyo (JP)

(72) Inventors: Takahiro Miyamoto, Tokyo (JP); Norihisa Shiroyama, Kanagawa (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/631,544

(22) PCT Filed: Jun. 1, 2018

(86) PCT No.: PCT/JP2018/021105
§ 371 (c)(1),
(2) Date: Jan. 16, 2020

(87) PCT Pub. No.: WO2019/017085
PCT Pub. Date: Jan. 24, 2019

(65) Prior Publication Data

US 2020/0176842 A1 Jun. 4, 2020

(30) Foreign Application Priority Data

Jul. 20, 2017 (JP) ..... JP2017-140560

(51) Int. Cl.
*H01P 1/208* (2006.01)
*H01P 11/00* (2006.01)

(52) U.S. Cl.
CPC ..... *H01P 1/2084* (2013.01); *H01P 11/007* (2013.01)

(58) Field of Classification Search
CPC ..... H01P 1/2084; H01P 11/007
See application file for complete search history.

(56) References Cited

U.S. PATENT DOCUMENTS 4,761,625 A 8/1988 Sharma
7,057,482 B2 * 6/2006 Helme ..... H01P 1/207 333/209

(Continued)

FOREIGN PATENT DOCUMENTS

JP 62-202601 A 9/1987
JP 2013-93811 A 5/2013

(Continued)

OTHER PUBLICATIONS

International Search Report for PCT/JP2018/021105 dated Jul. 17, 2018 (PCT/ISA/210).

*Primary Examiner* — Robert J Pascal
*Assistant Examiner* — Kimberly E Glenn
(74) *Attorney, Agent, or Firm* — Sughrue Mion, PLLC

(57) ABSTRACT

A tunable bandpass filter (1A) includes a waveguide (11); a plurality of resonators (12) housed in the waveguide (11) and arranged in the lengthwise direction of the waveguide (11); a coupling member (13) disposed between two adjacent resonators (12); a ridge member (14) extending in the lengthwise direction of the waveguide (11) and connected to one end of the coupling member (13); and a dielectric plate (17) extending in the lengthwise direction of the waveguide (11), disposed adjacent to the plurality of resonators (12) in a direction orthogonal to the lengthwise direction of the waveguide (11), and movable in the direction orthogonal to the lengthwise direction of the waveguide (11).

6 Claims, 8 Drawing Sheets

(56) References Cited

U.S. PATENT DOCUMENTS

| | | | | |
|---|---|---|---|---|
| 8,878,635 | B2 * | 11/2014 | Miyamoto | H01P 1/207 333/209 |
| 2012/0126914 | A1 | 5/2012 | Miyamoto et al. | |

FOREIGN PATENT DOCUMENTS

| | | | |
|---|---|---|---|
| JP | 2016-119531 | A | 6/2016 |
| JP | 2018/021105 | | 7/2018 |
| WO | 2010/073554 | A1 | 7/2010 |

* cited by examiner

TUNABLE BANDPASS FILTER AND METHOD OF FORMING THE SAME

CROSS REFERENCE TO RELATED APPLICATIONS

This application is a National Stage of International Application No. PCT/JP2018/021105 filed Jun. 1, 2018, claiming priority based on Japanese Patent Application No. 2017-140560 filed Jul. 20, 2017, the disclosure of which is incorporated herein in its entirety by reference.

TECHNICAL FIELD

The present disclosure relates to a tunable bandpass filter and a method of forming the tunable bandpass filter.

BACKGROUND ART

For communication devices that transmit and receive signals with the use of a microwave band or a millimeter-wave band, there is known a bandpass filter that passes only a signal in a desired frequency band and removes an unwanted frequency component. Nowadays, there is an increasing demand that the passband of a bandpass filter be changed from the outside. An example of a tunable bandpass filter whose passband can be changed from the outside is disclosed in Patent Literature 1.

In the tunable bandpass filter disclosed in Patent Literature 1, a metal plate is sandwiched by a waveguide divided into half along a horizontal plane, and a plurality of capacitive fins are arranged in the metal plate in the lengthwise direction of the waveguide. A dielectric plate is disposed inside the waveguide along the lengthwise direction of the metal plate, and this dielectric plate is configured to be movable in the direction of the metal plate.

With the tunable bandpass filter disclosed in Patent Literature 1 and configured as described above, the center frequency of the passband can be changed by changing, from the outside, the position of the dielectric plate, that is, the distance between the dielectric plate and the metal plate.

CITATION LIST

Patent Literature

Patent Literature 1: Japanese Unexamined Patent Application Publication No. 2016-119531

SUMMARY OF INVENTION

Technical Problem

As described above, in the tunable bandpass filter disclosed in Patent Literature 1, the plurality of capacitive fins are formed and arranged in the metal plate sandwiched by the waveguide divided into half, and the distance between the dielectric plate and the metal plate is changed from the outside. Thus, the center frequency of the passband can be changed. Patent Literature 1 further indicates that the capacitive fins contribute to suppressing a change in the coupling coefficient between resonators that could occur when the center frequency of the passband is changed.

However, according to FIG. 5 of Patent Literature 1, the coupling coefficient changes greatly dependent on the frequency especially in a high frequency band. In general, when the coupling coefficient changes, the bandwidth of the passband changes.

Therefore, it is conceivable that, with the tunable bandpass filter disclosed in Patent Literature 1, changing the center frequency of the passband causes the coupling coefficient between the resonators to change and this also causes the bandwidth of the passband to change.

The present disclosure is directed to solving the above problem and to providing a tunable bandpass filter that can suppress a change in the bandwidth of a passband that could occur when the center frequency of the passband is changed and providing a method of forming such a tunable bandpass filter.

Solution to Problem

In one aspect, a tunable bandpass filter includes a waveguide;

a plurality of resonators housed in the waveguide and arranged in a lengthwise direction of the waveguide;

a coupling member disposed between two adjacent resonators;

a ridge member extending in the lengthwise direction of the waveguide and connected to one end of the coupling member; and a dielectric plate extending in the lengthwise direction of the waveguide, disposed adjacent to the plurality of resonators in a direction orthogonal to the lengthwise direction of the waveguide, and movable in the direction orthogonal to the lengthwise direction of the waveguide.

In one aspect, a method of forming a tunable bandpass filter includes housing, in a waveguide, a plurality of resonators arranged in a lengthwise direction of the waveguide;

disposing a coupling member between two adjacent resonators;

disposing a ridge member extending in the lengthwise direction of the waveguide and connected to one end of the coupling member; and disposing a dielectric plate adjacent to the plurality of resonators in a direction orthogonal to the lengthwise direction of the waveguide, the dielectric plate extending in the lengthwise direction of the waveguide and being movable in the direction orthogonal to the lengthwise direction of the waveguide.

Advantageous Effects of Invention

The above aspects can advantageously provide a tunable bandpass filter that can suppress a change in the bandwidth that could occur when the center frequency of the passband is changed and a method of forming such a tunable bandpass filter.

DESCRIPTION OF EMBODIMENTS

Hereinafter, with reference to the drawings, an embodiment of the present disclosure will be explained. Further, specific numerical values and the like stated in the following embodiments are merely examples for facilitating understanding of the present disclosure, and are not limited thereto.

(1) First Embodiment

Figure 1:
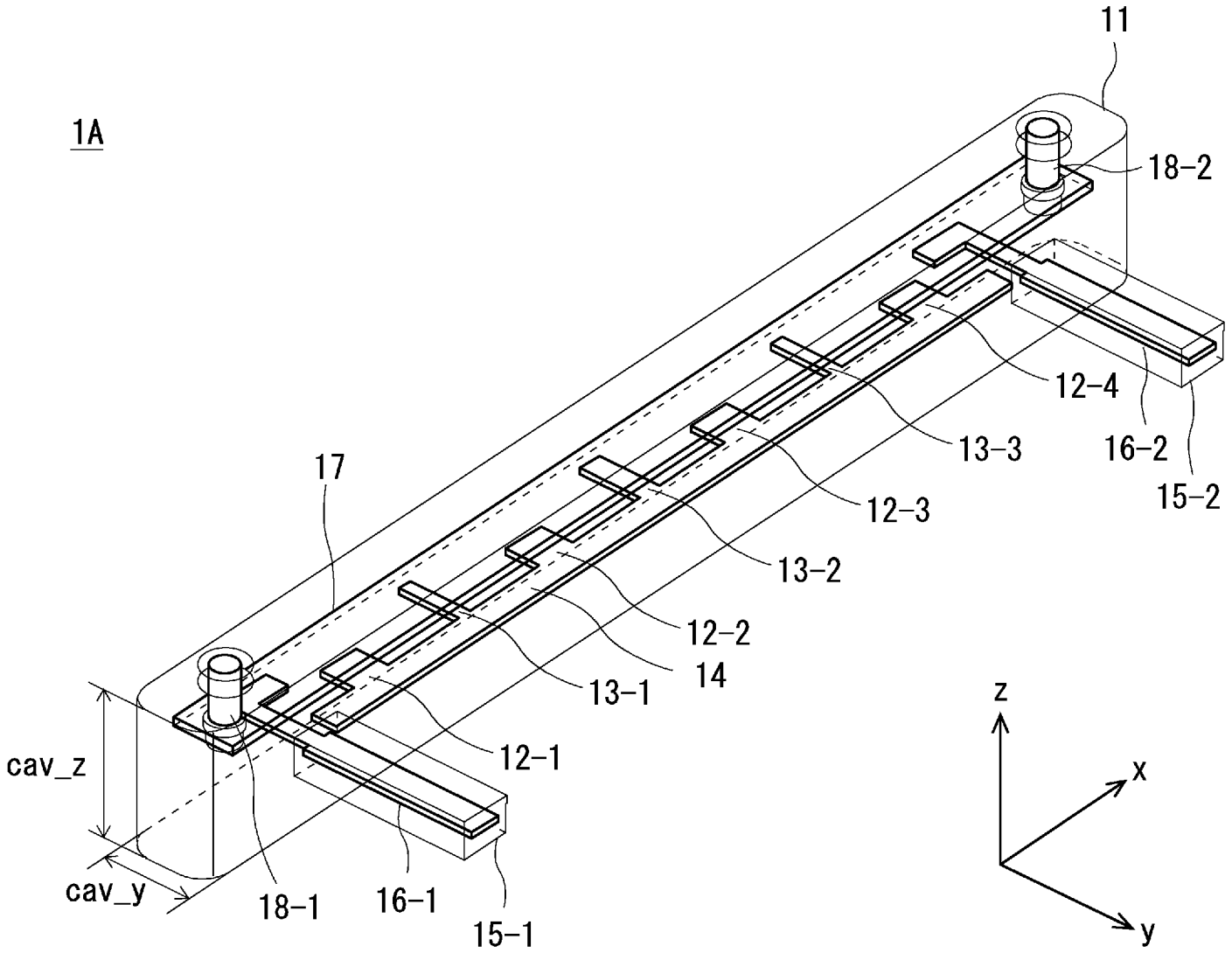
FIG. 1 is a perspective view illustrating a configuration example of a tunable bandpass filter according to a first embodiment.
Figure 2:
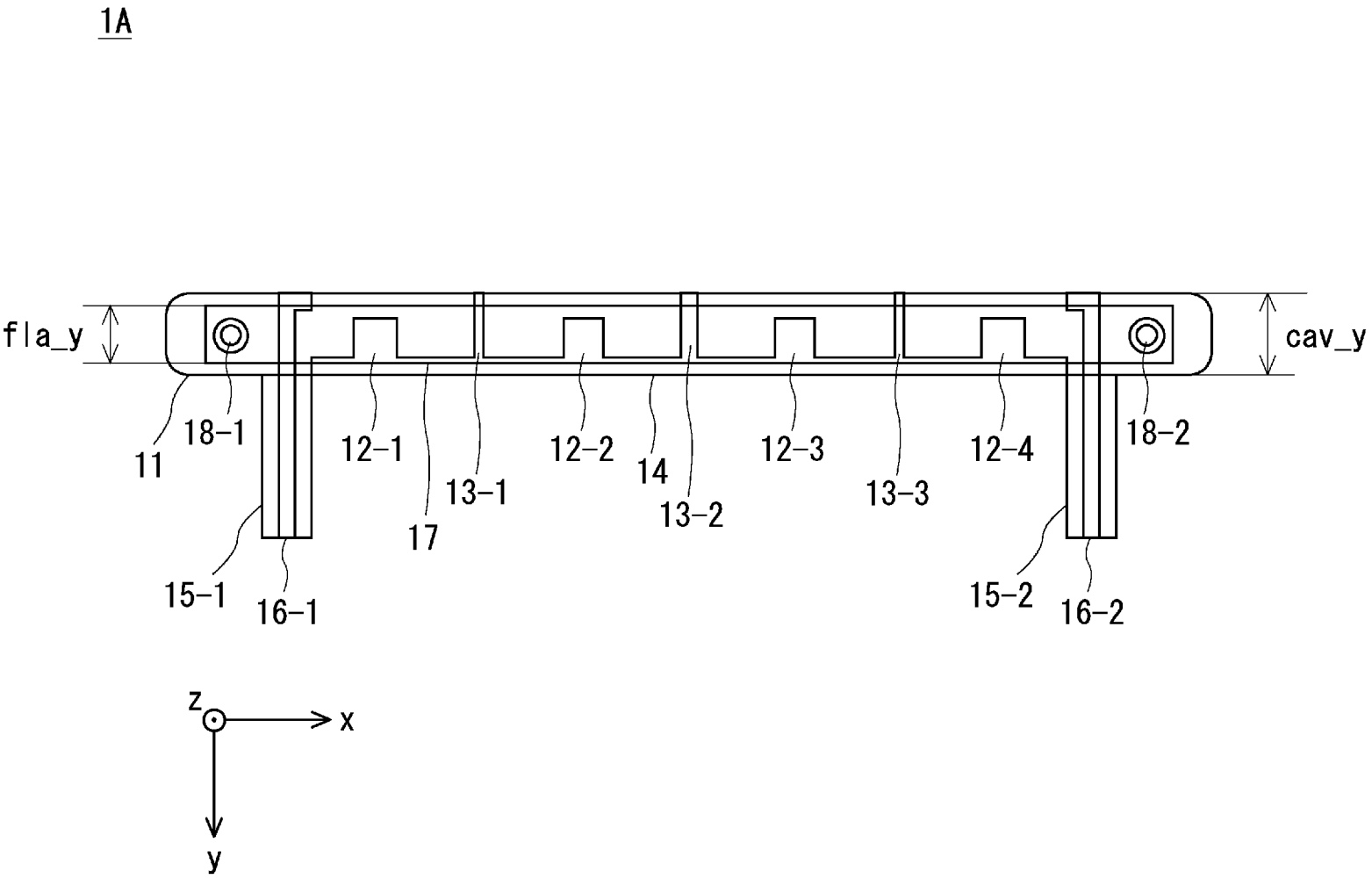
FIG. 2 is a top view illustrating a configuration example of the tunable bandpass filter according to the first embodiment.
Figure 3:
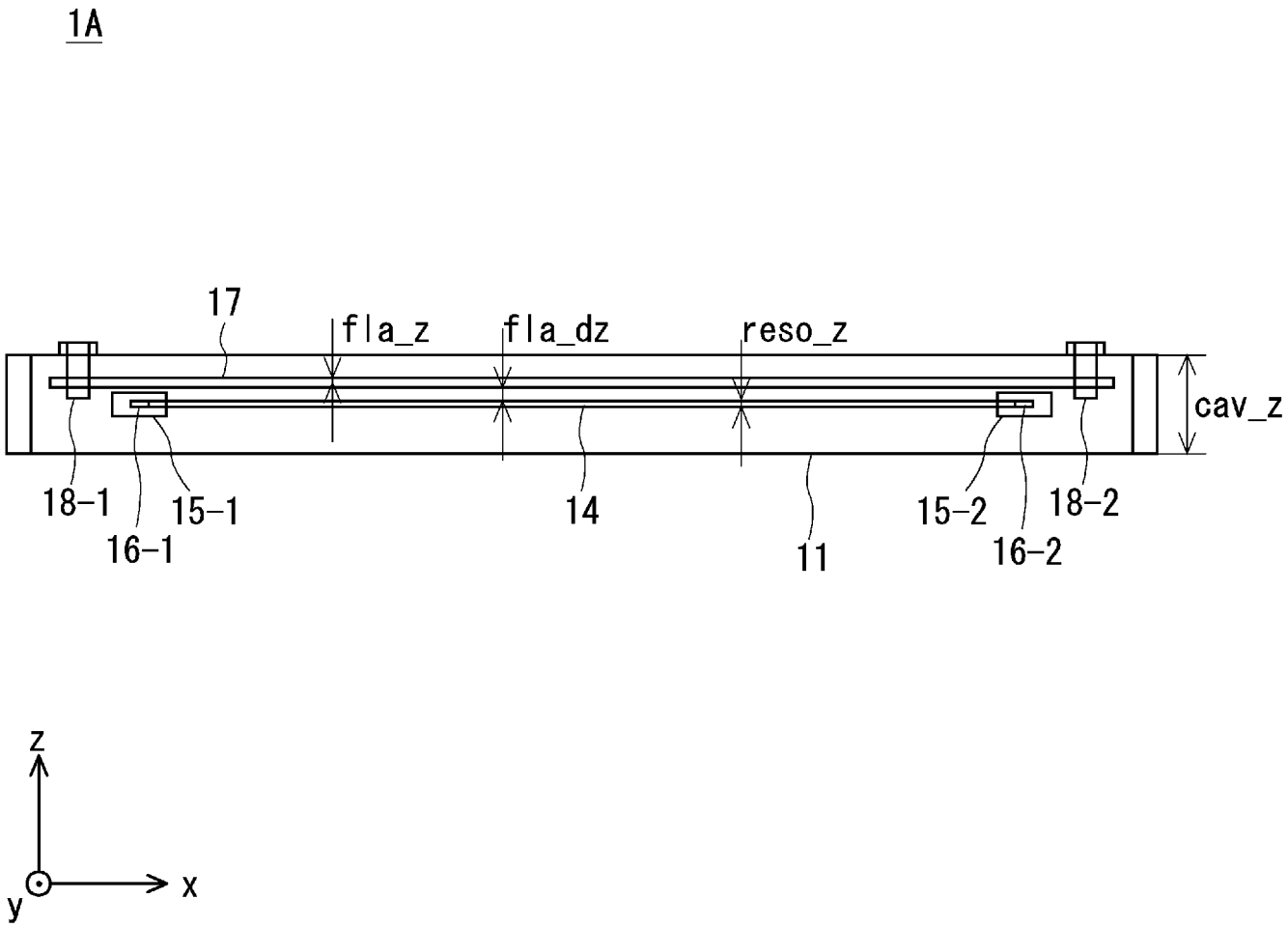
FIG. 3 is a side view illustrating a configuration example of the tunable bandpass filter according to the first embodiment.
Figure 4:
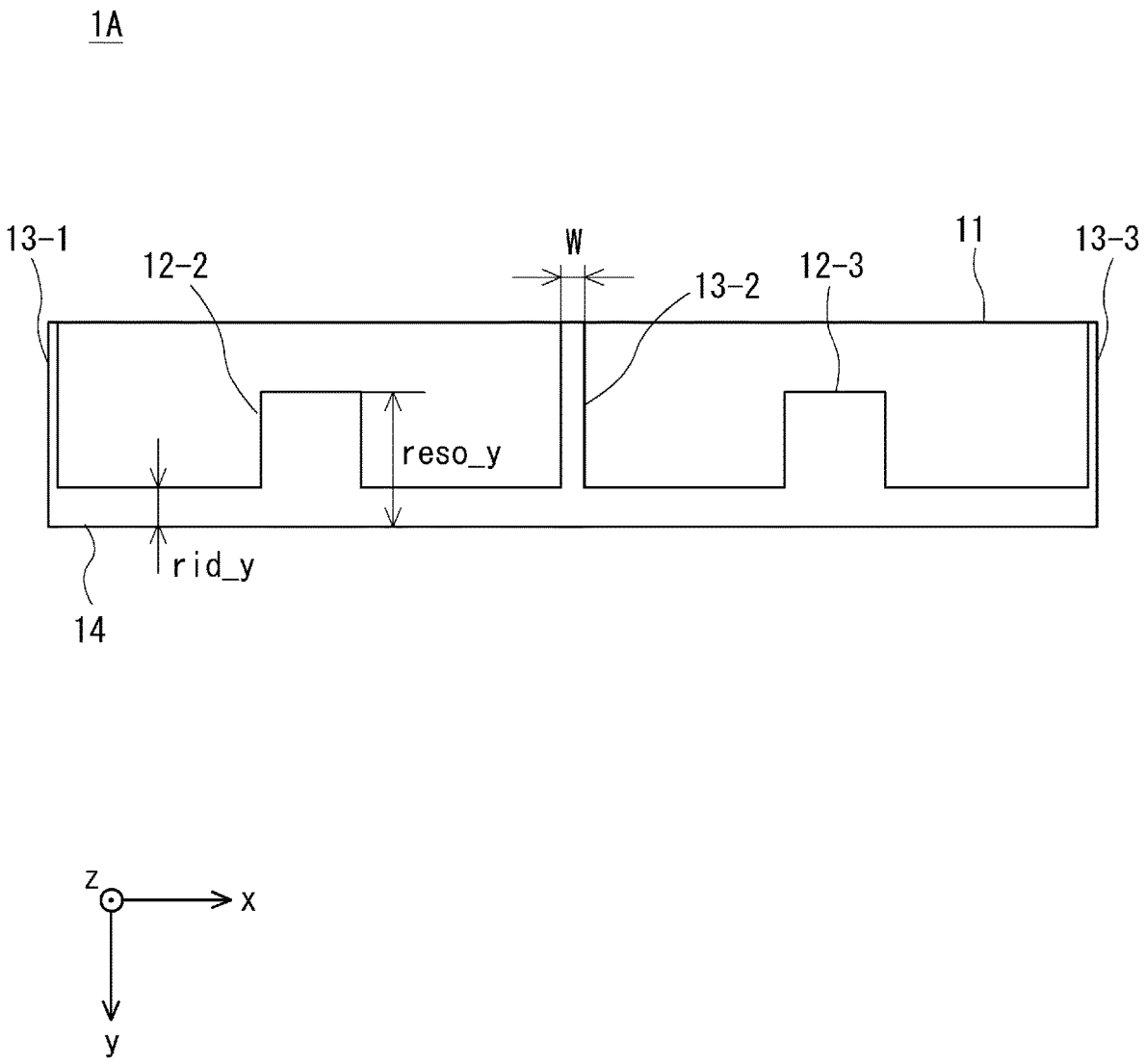
FIG. 4 is an enlarged top view of the vicinity of second-stage and third-stage resonator plates illustrated in FIG. 2.

FIGS. 1 to 3 are, respectively, a perspective view, a top view, and a side view illustrating a configuration example of a tunable bandpass filter 1A according to a first embodiment. FIG. 4 is an enlarged top view of the vicinity of second-stage and third-stage resonator plates 12-2 and 12-3 illustrated in FIG. 2. In FIG. 4, a flap 17 is omitted.

As illustrated in FIGS. 1 to 4, the tunable bandpass filter 1A according to the first embodiment includes a waveguide 11, four resonator plates 12-1 to 12-4, three coupling plates 13-1 to 13-3, a ridge plate 14, two input/output ports 15-1 and 15-2, a flap 17, and two support rods 18-1 and 18-2. In the following, when the resonator plates 12-1 to 12-4 are not particularly distinguished from one another, the resonator plates 12-1 to 12-4 may be referred to simply as the "resonator plate(s) 12." In a similar manner, the coupling plates 13-1 to 13-3 may be referred to simply as the "coupling plate(s) 13," the input/output ports 15-1 and 15-2 may be referred to simply as the "input/output port(s) 15," and the support rods 18-1 and 18-2 may be referred to simply as the "support rod(s) 18." In addition, center conductors 16-1 and 16-2 in the input/output ports 15-1 and 15-2, described later, may be referred to simply as the "center conductor(s) 16."

The tunable bandpass filter 1A according to the first embodiment is a four-stage bandpass filter that includes the four resonator plates 12-1 to 12-4. The number of the stages in the tunable bandpass filter 1A is not limited to four and may be two or more.

The waveguide 11 is a conductive rectangular waveguide that houses, in its cavity, the resonator plates 12-1 to 12-4, the coupling plates 13-1 to 13-3, the ridge plate 14, the flap 17, and so on. The material of the waveguide 11 may be any metal having high conductivity and is, for example, aluminum.

The resonator plates 12-1 to 12-4 are each a semi-coaxial resonator constituted by a plate-like conductor. One ends (the positive side ends in the y-direction) of the resonator plates 12-1 to 12-4 are connected to the ridge plate 14, described later, and the other ends (the negative side ends in the y-direction) are open ends (i.e., not connected to any member). The resonator plates 12-1 to 12-4 are arranged in the lengthwise direction (x-direction) of the waveguide 11 such that the side surfaces of the resonator plates 12 oppose each other. The resonator plates 12-1 to 12-4 operate so as to resonate at a resonance frequency that is determined by their shape, their length (y-direction), or the like.

The coupling plates 13-1 to 13-3 are each a coupling member constituted by a conductor. One ends (the positive side ends in the y-direction) of the coupling plates 13-1 to 13-3 are connected to the ridge plate 14, described later, and the other ends (the negative side ends in the y-direction) are connected to the inner wall on the other side (the negative side inner wall in the y-direction) of the waveguide 11. The coupling plates 13-1 to 13-3 may also be referred to as irises. The coupling plates 13-1 to 13-3 are each disposed between two adjacent resonator plates 12 such that the side surfaces of the coupling plates 13 oppose the side surfaces of the resonator plates 12. The coupling plates 13-1 to 13-3 are provided to suppress spurious (unwanted resonance).

The ridge plate 14 is a ridge member constituted by a conductor. The ridge plate 14 extends in the lengthwise direction (x-direction) of the waveguide 11, and a side surface of the ridge plate 14 is connected to one of the inner walls (the positive side inner wall in the y-direction) of the waveguide 11. The ridge plate 14 is connected to the one ends (the positive side ends in the y-direction) of the resonator plates 12-1 to 12-4 and is connected to the one ends (the positive side ends in the y-direction) of the coupling plates 13-1 to 13-3. The ridge plate 14 is provided to increase the coupling coefficient between two adjacent resonator plates 12. It suffices that the length of the ridge plate 14 in the x-direction be no less than the length that allows the ridge plate 14 to reach the resonator plates 12-1 and 12-4 at the respective ends in the x-direction.

The input/output ports 15-1 and 15-2 are ports for inputting and/or outputting a high-frequency signal. The input/output port 15-1 is constituted by a coaxial line. The center conductor 16-1 of that coaxial line is inserted, at one end (the negative side end in the x-direction) of the waveguide 11, through a side surface (on the positive side in the y-direction) of the waveguide 11 and connected to the resonator plate 12-1 through electromagnetic coupling. The input/output port 15-2 is constituted by a coaxial line. The center conductor 16-2 of that coaxial line is inserted, at the other end (the positive side end in the x-direction) of the waveguide 11, through the side surface (on the positive side in the y-direction) of the waveguide 11 and connected to the resonator plate 12-4 through electromagnetic coupling. The center conductors 16-1 and 16-2 are constituted by plate-like conductors. The input/output ports 15-1 and 15-2 are not limited to the coaxial lines and may each be constituted by a waveguide line. One of the input/output ports 15-1 and 15-2 operates as an input port, and the other one operates as an output port. For example, when the input/output port 15-1 operates as an input port and the input/output port 15-2 operates as an output port, a high-frequency signal is input to the input/output port 15-1, and only a portion of that high-frequency signal that is in a passband of the tunable bandpass filter 1A is output from the input/output port 15-2.

The waveguide 11 is divided into two members along a horizontal plane, and the two divided members sandwich a conductor plate. The resonator plates 12-1 to 12-4, the coupling plates 13-1 to 13-3, the ridge plate 14, the center conductors 16-1 and 16-2 of the input/output ports 15-1 and 15-2, and so on are formed integrally in the stated conductor plate. Accordingly, the resonator plates 12-1 to 12-4, the coupling plates 13-1 to 13-3, the ridge plate 14, the center conductors 16-1 and 16-2, and so on are located in the same plane (the horizontal plane in FIGS. 1 to 4).

Since the resonator plates 12-1 to 12-4, the coupling plates 13-1 to 13-3, the ridge plate 14, and the center conductors 16-1 and 16-2 of the input/output ports 15-1 and 15-2 are formed integrally in the conductor plate sandwiched by the waveguide divided into half as described above, these members are formed of the same material. The material of the resonator plates 12-1 to 12-4, the coupling plates 13-1 to 13-3, the ridge plate 14, and the center conductors 16-1 and 16-2 may be any metal having high conductivity and is, for example, copper. The resonator plates 12-1 to 12-4, the coupling plates 13-1 to 13-3, the ridge plate 14, and the center conductors 16-1 and 16-2 may each be constituted by an insulator, such as plastics, having its surface plated with a metal having high conductivity.

The flap 17 is a plate-like dielectric plate. The flap 17 extends in the lengthwise direction (x-direction) of the waveguide 11 and is disposed adjacent to the resonator plates 12-1 to 12-4 in a direction (z-direction) orthogonal to the lengthwise direction of the waveguide 11. A principal surface (a surface having the largest area) of the flap 17 opposes principal surfaces of the resonator plates 12-1 to 12-4. It suffices that the length of the flap 17 in the x-direction be no less than the length that allows the flap 17 to overlap the input/output ports 15-1 and 15-2 at the respective ends in the x-direction. The flap 17 is configured to be movable in the z-direction. This configuration makes it possible to change the position of the flap 17 in the z-direction, that is, the distance between the resonator plates 12-1 to 12-4 and the flap 17. Accordingly, with the tunable bandpass filter 1A according to the first embodiment, the center frequency of the passband can be changed by changing, from the outside, the distance between the resonator plates 12-1 to 12-4 and the flap 17. The material of the flap 17 may be any dielectric member having a relative permittivity of $\varepsilon r>1$ and is, for example, alumina.

The support rods 18-1 and 18-2 are attached at the respective ends of the flap 17 in the x-direction. The support rods 18-1 and 18-2 are displaced in the z-direction with the use of a stepping motor (not illustrated) provided outside the tunable bandpass filter 1A, and thus the flap 17 can be moved in the z-direction. The material of the support rods 18-1 and 18-2 is, for example, zirconia. The above-described method of moving the flap 17 with the use of the support rods 18-1 and 18-2 is merely an example, this method is not a limiting example.

As described above, in the tunable bandpass filter 1A according to the first embodiment, the resonator plates 12-1 to 12-4 are arranged in the lengthwise direction (x-direction) of the waveguide 11, and the coupling plates 13-1 to 13-3 are each disposed between two adjacent resonator plates 12 to suppress spurious.

The coupling plates 13-1 to 13-3 have not only an effect of suppressing spurious but also an effect of reducing the coupling coefficient between two adjacent resonator plates 12. Therefore, the presence of the coupling plates 13-1 to 13-3 helps reduce the coupling coefficient.

The bandwidth of the passband is dependent on the coupling coefficient, and as the coupling coefficient decreases, the bandwidth decreases. Therefore, the decrease in the coupling coefficient makes it impossible to obtain a desired bandwidth.

Accordingly, in the first embodiment, the ridge plate 14 that extends in the lengthwise direction (x-direction) of the waveguide 11 is disposed, and the one ends (the positive side ends in the y-direction) of the coupling plates 13-1 to 13-3 are connected to the ridge plate 14. This configuration helps increase the coupling coefficient between two adjacent resonator plates 12.

Figure 5:
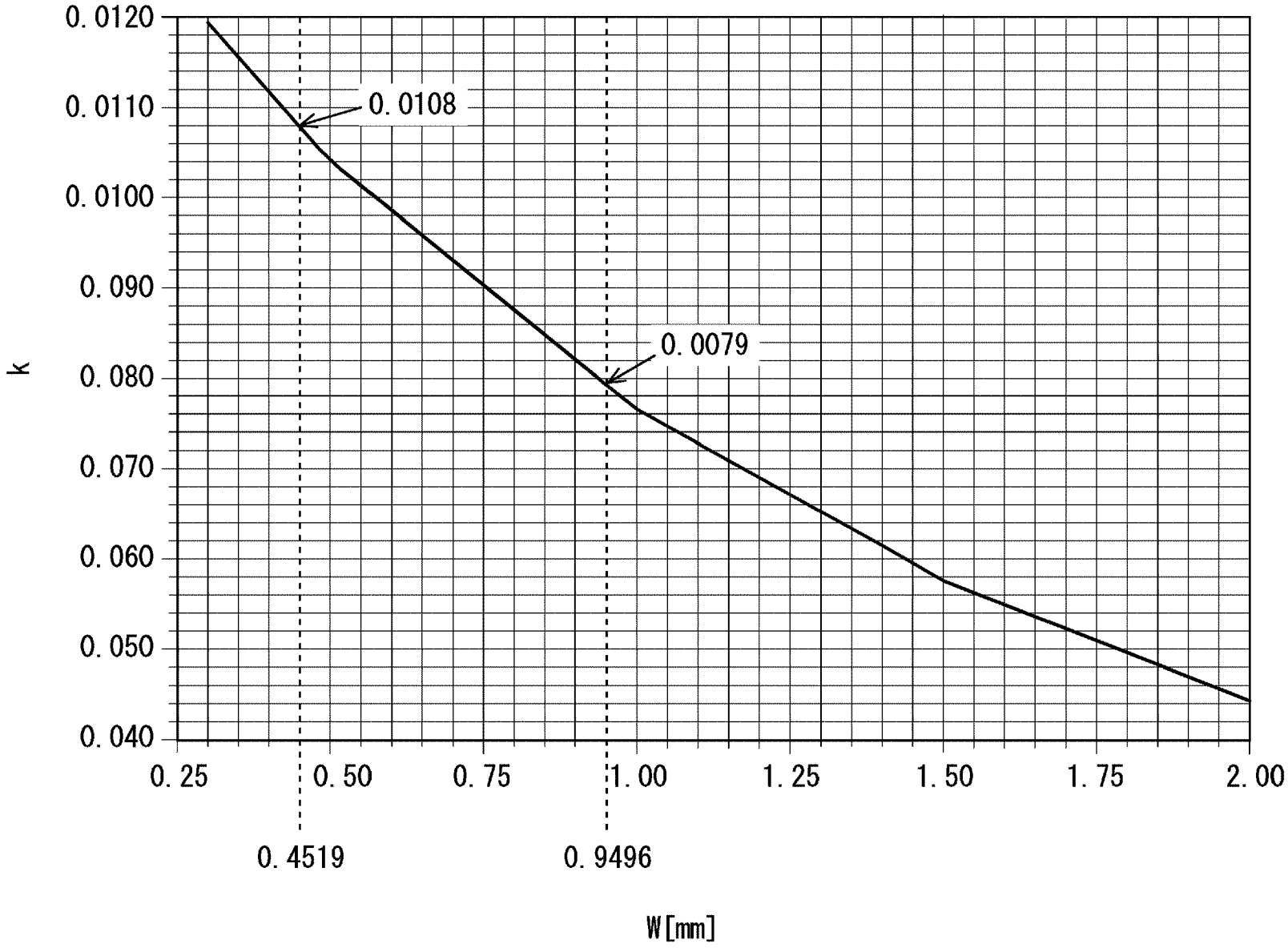
FIG. 5 is a graph illustrating an example of a coupling coefficient in the tunable bandpass filter according to the first embodiment.

With reference to FIG. 5, the following description shows that the effect of the ridge plate 14 can increase the coupling coefficient between two adjacent resonator plates 12.

In the tunable bandpass filter 1A, the width W (x-direction) of the three coupling plates 13-1 to 13-3 is varied. Aside from this, the tunable bandpass filter 1A is configured in accordance with the following conditions.

Width cav_y (y-direction) of waveguide 11: 5 [mm]

Height cav_z (z-direction) of waveguide 11: 8 [mm]

Height reso_y (y-direction) of resonator plate 12: 3.3 [mm]

Thickness reso_z (z-direction) of resonator plate 12: 0.3 [mm]

Height rid_y (y-direction) of ridge plate 14: 1 [mm]

Width fla_y (y-direction) of flap 17: 3.5 [mm]

Thickness fla_z (z-direction) of flap 17: 0.5 [mm]

Position fla_dz (z-direction) of flap 17: 1.8 [mm]

The position fla_dz of the flap 17 represents the distance between the resonator plates 12-1 to 12-4 and the flap 17. The height reso_y of the resonator plates 12 and the height rid_y of the ridge plate 14 each represent the distance from the one inner wall (the positive side inner wall in the y-direction) of the waveguide 11. The thickness (z-direction) of each of the coupling plates 13, the ridge plate 14, and the center conductors 16 of the input/output ports 15 is equal to the thickness reso_z of the resonator plates 12.

FIG. 5 is a graph illustrating an example of the coupling coefficient in the tunable bandpass filter 1A according to the first embodiment. In FIG. 5, the horizontal axis represents the width W [mm] (x-direction) of the coupling plates 13-1 to 13-3, and the vertical axis represents the coupling coefficient k between two adjacent resonator plates 12.

Herein, an index used for the bandwidth of the passband is a 3-dB width index associated with S21 of the S-parameter. S21 represents the pass characteristics of a high-frequency signal and indicates a pass loss (also referred to as an insertion loss) with respect to the frequency. The 3-dB width indicates a gap between the frequencies at two points where S21 [dB] takes a value that is smaller (greater in the negative direction) by 3 [dB] than a peak value. Herein, 220 [MHz] is required as the 3-dB width. To achieve 3-dB width of 220 [MHz], the coupling coefficient k needs to satisfy a lower limit value of $k_2$=0.00794 and an upper limit value of $k_1$=0.0108.

FIG. 5 reveals that, in the first embodiment, the presence of the ridge plate 14 can help achieve the coupling coefficient k of 0.012 at the minimum, which is sufficiently large. Therefore, as the width W of the three coupling plates 13-1 to 13-3 is set to $W_2$=0.9496 [mm], the coupling coefficient k can satisfy the lower limit value of $k_2$=0.00794. Furthermore, as the width W is set to $W_1$=0.4519 [mm], the coupling coefficient k can also satisfy the upper limit value of $k_1$=0.0108.

Accordingly, it can be seen that, in the first embodiment, the effect of the ridge plate 14 can help increase the coupling coefficient k between two adjacent resonator plates 12, and this can help obtain a desired bandwidth. The coupling coefficient k can be further increased by further increasing the height rid_y of the ridge plate 14.

In the first embodiment, the center frequency of the passband can be changed by changing, from the outside, the distance between the resonator plates 12-1 to 12-4 and the flap 17. Even when the center frequency of the passband is changed, the effect of the ridge plate 14 can help suppress a change in the coupling coefficient between two adjacent resonator plates 12, and this can help suppress a change in the bandwidth of the passband.

Figure 6:
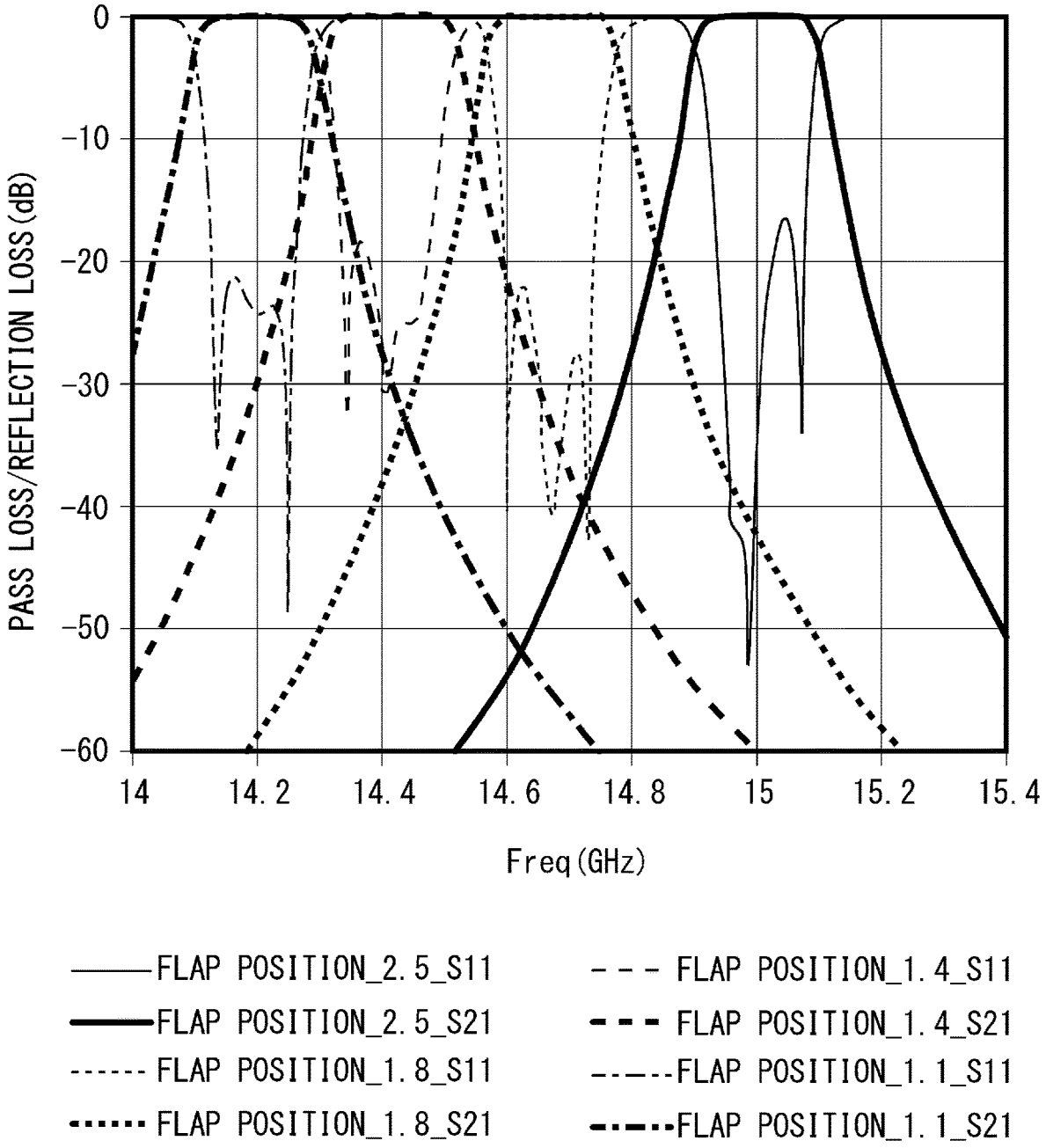
FIG. 6 is a graph illustrating an example of filter characteristics of the tunable bandpass filter according to the first embodiment.

With reference to Table 1 and FIG. 6, the following description shows that, when the center frequency of the passband has been changed, the effect of the ridge plate 14 can help suppress a change in the coupling coefficient between two adjacent resonator plates 12 in the first embodiment, and this can help suppress a change in the bandwidth of the passband.

In this case, in the tunable bandpass filter 1A, the position fla_dz (z-direction) of the flap 17 is varied. The width W (x-direction) of the coupling plates 13-1 and 13-3 is set to 0.45 [mm], and the width W (x-direction) of the coupling plate 13-2 is set to 0.95 [mm]. Aside from the above, the tunable bandpass filter 1A is configured in accordance with the conditions similar to those in the case of FIG. 5.

Table 1 illustrates examples of the center frequency f0 [MHz] of the passband, the difference Δf [MHz] in the center frequency f0, the 3-dB width [MHz] of S21, and the coupling coefficient k between two adjacent resonator plates 12 held when the position fla_dz [mm] of the flap 17 is varied in the tunable bandpass filter 1A. In Table 1, the center frequency f0 [MHz] held when the position fla_dz of the flap 17 is 2.5 [mm] serves as a reference value, and Δf indicates the difference from that reference value. A coupling coefficient k12 is a coupling coefficient between the resonator plates 12-1 and 12-2, a coupling coefficient k34 is a coupling coefficient between the resonator plates 12-3 and 12-4, and a coupling coefficient k23 is a coupling coefficient between the resonator plates 12-2 and 12-3.

TABLE 1

| FLAP POSITION fla_dz [mm] | f0 [MHz] | Δf [MHz] | 3-dB WIDTH [MHz] | COUPLING COEFFICIENT k12 = k34 | COUPLING COEFFI-CIENT k23 |
|---|---|---|---|---|---|
| 2.5 | 15005 | — | 197 | 0.00968 | 0.00711 |
| 1.8 | 14675 | 330 | 203 | 0.010199 | 0.007491 |
| 1.4 | 14423 | 582 | 200 | 0.010223 | 0.007509 |
| 1.1 | 14146 | 859 | 202 | 0.010528 | 0.007733 |

FIG. 6 is a graph illustrating an example of filter characteristics of the tunable bandpass filter 1A according to the first embodiment (a simulation result from a high-frequency electric field simulator). In FIG. 6, the horizontal axis represents the frequency [GHz], and the vertical axis represents the reflection loss (the return loss, S11 of the S-parameter) and the pass loss (S21 of the S-parameter) [dB]. S11 represents the reflection characteristics of a high-frequency signal and indicates the reflection loss with respect to the frequency. S21 is as described above.

Table 1 and FIG. 6 reveal that, in the first embodiment, as the position fla_dz of the flap 17 is changed, the center frequency f0 of the passband changes. Specifically, as the position fla_dz of the flap 17 is raised, that is, as the flap 17 is moved further away from the resonator plates 12-1 to 12-4, the center frequency f0 of the passband increases. Meanwhile, it can be seen that, even when the center frequency f0 of the passband has changed, little change is observed in the 3-dB width and the coupling coefficients k12, k34, and k23. Specifically, even when the position fla_dz of the flap 17 is varied in a range of from 1.1 [mm] to 2.5 [mm], the change in the 3-dB width is kept to 6 [MHz], the change in the coupling coefficients k12 and k34 is kept to 0.000848, and the change in the coupling coefficient k23 is kept to 0.000623.

Accordingly, it can be seen that, in the first embodiment, even when the center frequency of the passband is changed, the effect of the ridge plate 14 can help suppress a change in the coupling coefficient between two adjacent resonator plates 12, and this can help suppress a change in the bandwidth of the passband.

As described above, in the tunable bandpass filter 1A according to the first embodiment, the resonator plates 12-1 to 12-4 are arranged in the lengthwise direction (x-direction) of the waveguide 11, and the coupling plates 13-1 to 13-3 are each disposed between two adjacent resonator plates 12. This configuration can suppress spurious.

Furthermore, the ridge plate 14 that extends in the lengthwise direction (x-direction) of the waveguide 11 is disposed, and the one ends (the positive side ends in the y-direction) of the coupling plates 13-1 to 13-3 are connected to the ridge plate 14. This configuration can help increase the coupling coefficient between two adjacent resonator plates 12. In addition, a change in the coupling coefficient that could occur when the center frequency of the passband is changed by moving the flap 17 can be suppressed, and this can help suppress a change in the bandwidth of the passband.

(2) Second Embodiment

Figure 7:
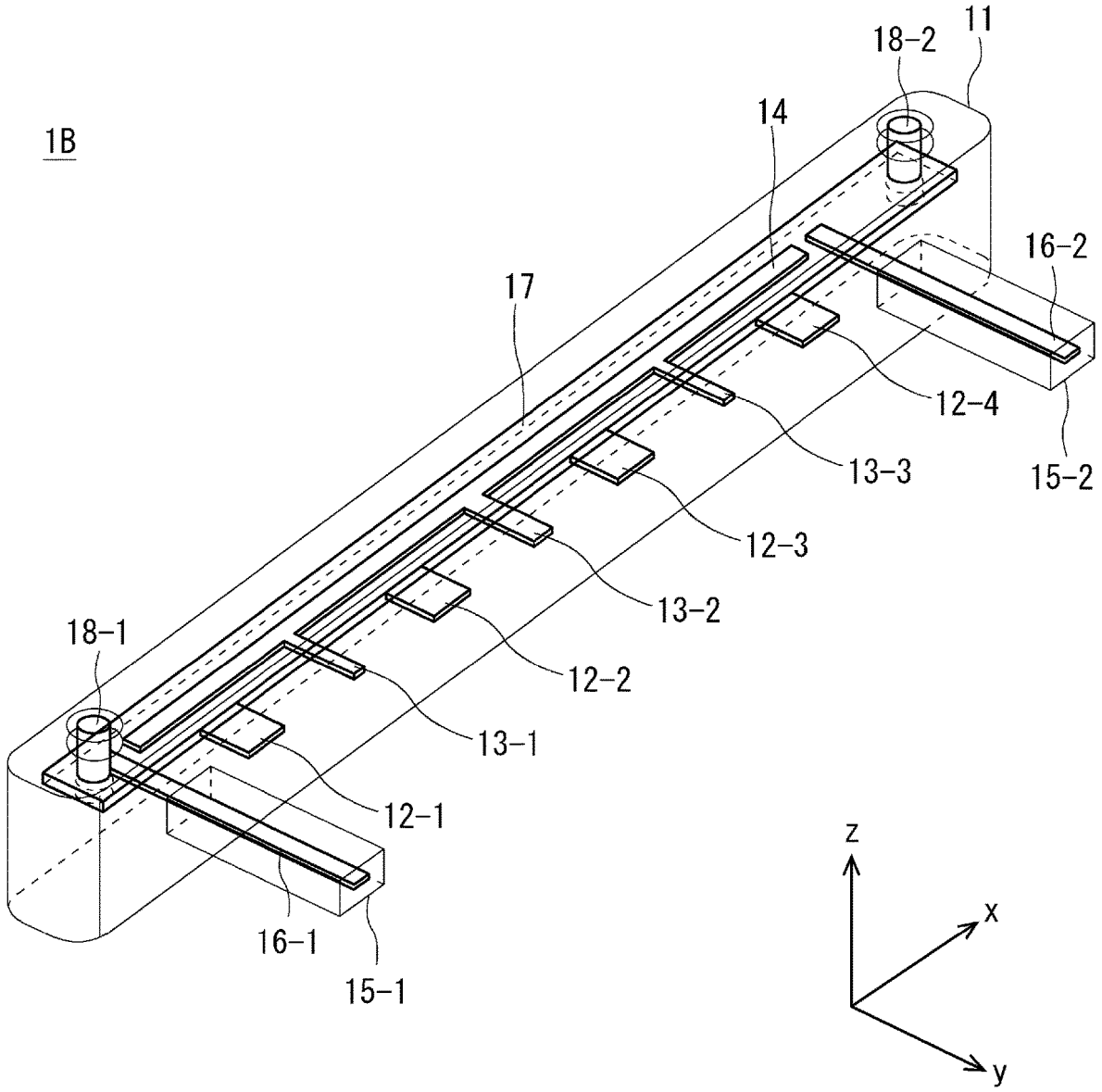
FIG. 7 is a perspective view illustrating a configuration example of a tunable bandpass filter according to a second embodiment.
Figure 8:
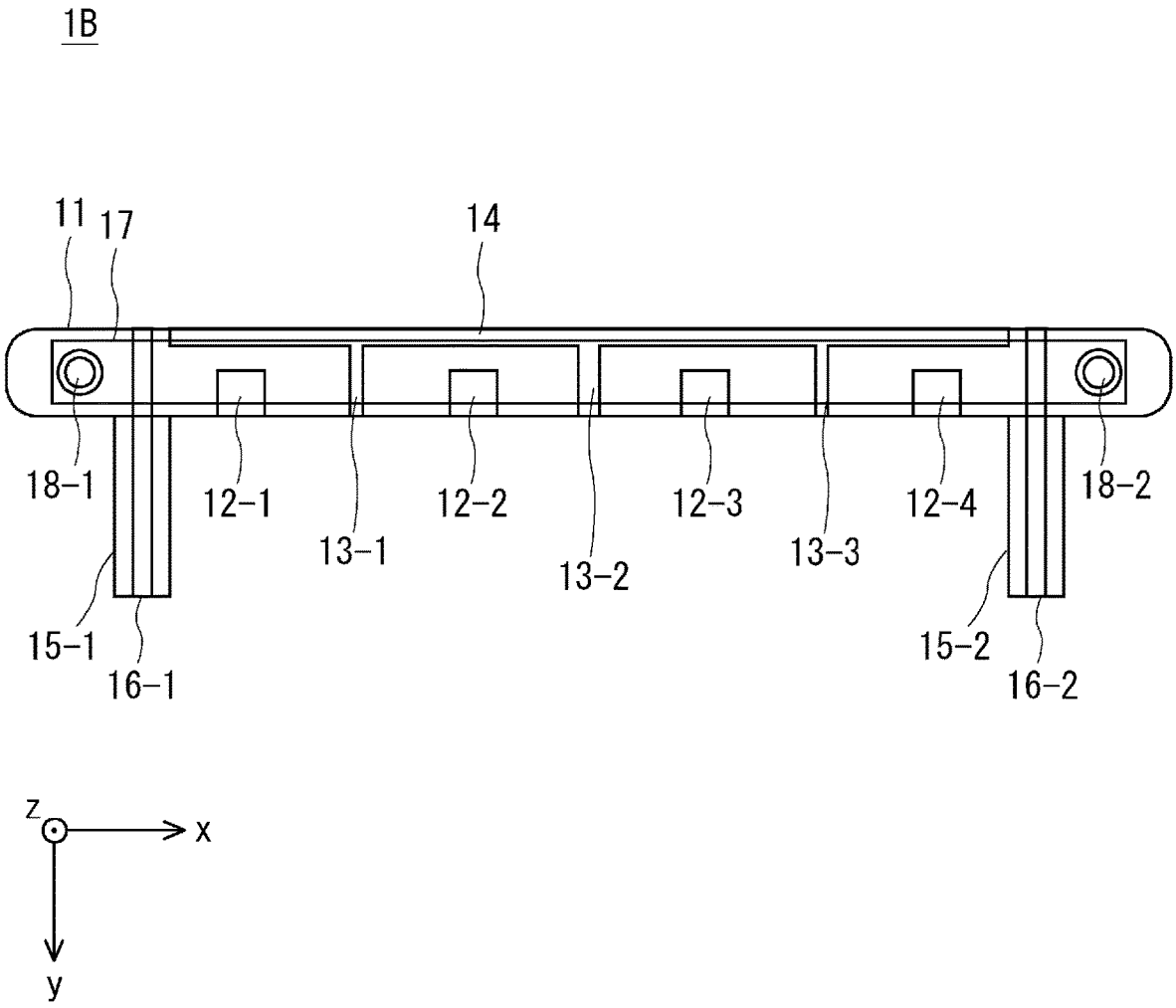
FIG. 8 is a top view illustrating a configuration example of the tunable bandpass filter according to the second embodiment.

FIGS. 7 and 8 are, respectively, a perspective view and a top view illustrating a configuration example of a tunable bandpass filter 1B according to a second embodiment.

As illustrated in FIGS. 7 and 8, the tunable bandpass filter 1B according to the second embodiment differs from the tunable bandpass filter 1A according to the first embodiment described above in terms of the position of the ridge plate 14.

Specifically, in the first embodiment described above, the ridge plate 14 is disposed on the one inner wall (the positive side inner wall in the y-direction) of the waveguide 11. In contrast, in the second embodiment, the ridge plate 14 is disposed on the other inner wall (the negative side inner wall in the y-direction) of the waveguide 11.

Along with this change in the position of the ridge plate 14, the one ends (the positive side ends in the y-direction) of the coupling plates 13-1 to 13-3 are connected to the one inner wall (the positive side inner wall in the y-direction) of the waveguide 11, and the other ends of the coupling plates 13-1 to 13-3 are connected to the ridge plate 14. Meanwhile, the one ends (the positive side ends in the y-direction) of the resonator plates 12-1 to 12-4 are connected to the one inner wall (the positive side inner wall in the y-direction) of the waveguide 11, and the other ends (the negative side ends in the y-direction) of the resonator plates 12-1 to 12-4 are open ends.

Aside from the configuration described above, the second embodiment is similar to the first embodiment, and thus any further description will be omitted.

Although the position of the ridge plate 14 is different, the second embodiment is similar in configuration to the first embodiment in that the ridge plate 14 extends in the lengthwise direction (x-direction) of the waveguide 11 and the coupling plates 13-1 to 13-3 are connected to the ridge plate 14. Accordingly, the second embodiment provides an effect similar to that of the first embodiment described above.

Thus far, the invention of the present application has been described with reference to the foregoing embodiments, but the invention of the present application is not limited to the foregoing embodiments. Various modifications that a person skilled in the art can appreciate can be made to the configurations and the details of the invention of the present application within the scope of the invention of the present application.

For example, in the foregoing embodiments, the resonators, the coupling members, the ridge member, and the center conductors of the input/output ports each have a plate-like shape, and this provides an advantage in that these members can be formed integrally in a single conductor plate. However, the shape of the resonators, the coupling members, the ridge member, and the center conductors of the input/output ports is not limited to a plate-like shape. The shape of the resonators, the coupling members, the ridge member, and the center conductors of the input/output ports may be, for example, a circular column, a rectangular parallelepiped, or the like.

REFERENCE SIGNS LIST

1A, 1B TUNABLE BANDPASS FILTER
11 WAVEGUIDE
12-1 TO 12-4 RESONATOR PLATE
13-1 TO 13-3 COUPLING PLATE
14 RIDGE PLATE
15-1, 15-2 INPUT/OUTPUT PORT
16-1, 16-2 CENTER CONDUCTOR
17 FLAP
18-1, 18-2 SUPPORT ROD

The invention claimed is:

1. A tunable bandpass filter comprising:
a waveguide;
a plurality of resonators housed in the waveguide and arranged in a lengthwise direction of the waveguide;
a coupling member disposed between two adjacent resonators among the plurality of resonators;
a ridge member extending in the lengthwise direction of the waveguide and connected to one end of the coupling member; and
a dielectric plate extending in the lengthwise direction of the waveguide, disposed adjacent to the plurality of resonators in a direction orthogonal to the lengthwise direction of the waveguide, and movable in the direction orthogonal to the lengthwise direction of the waveguide,
wherein
one end of each of the plurality of resonators is connected to an inner wall of the waveguide, and
another end of each of the plurality of resonators is an open end.

2. The tunable bandpass filter according to claim 1, wherein the ridge member is disposed on another inner wall of the waveguide.

3. The tunable bandpass filter according to claim 1, wherein the plurality of resonators, the coupling member, and the ridge member are plate-like members located in the same plane.

4. The tunable bandpass filter according to claim 3, wherein
the waveguide is divided into two members along the plane with a plate-like conductor plate being sandwiched by the two members, and
the plurality of resonators, the coupling member, and the ridge member are formed integrally in the conductor plate.

5. The tunable bandpass filter according to claim 1, wherein a passband is changed by changing a distance between the plurality of resonators and the dielectric plate.

6. A method of forming a tunable bandpass filter, the method comprising:
housing, in a waveguide, a plurality of resonators arranged in a lengthwise direction of the waveguide;
disposing a coupling member between two adjacent resonators among the plurality of resonators;
disposing a ridge member extending in the lengthwise direction of the waveguide and connected to one end of the coupling member; and
disposing a dielectric plate adjacent to the plurality of resonators in a direction orthogonal to the lengthwise direction of the waveguide, the dielectric plate extending in the lengthwise direction of the waveguide and being movable in the direction orthogonal to the lengthwise direction of the waveguide,
wherein
one end of each of the plurality of resonators is connected to an inner wall of the waveguide, and
another end of each of the plurality of resonators is an open end.

* * * * *